US008910858B2

(12) United States Patent
McDonald

(10) Patent No.: US 8,910,858 B2
(45) Date of Patent: Dec. 16, 2014

(54) MEDICATION CALCULATOR AND RECORDER

(75) Inventor: Peter McDonald, Nelson (NZ)

(73) Assignee: Sweetlevels Limited, Nelson (NZ)

( * ) Notice: Subject to any disclaimer, the term of this patent is extended or adjusted under 35 U.S.C. 154(b) by 9 days.

(21) Appl. No.: 13/997,436

(22) PCT Filed: Dec. 22, 2011

(86) PCT No.: PCT/NZ2011/000273
§ 371 (c)(1),
(2), (4) Date: Oct. 7, 2013

(87) PCT Pub. No.: WO2012/087162
PCT Pub. Date: Jun. 28, 2012

(65) Prior Publication Data

US 2014/0014026 A1 Jan. 16, 2014

(30) Foreign Application Priority Data

Dec. 24, 2010 (NZ) ..... 590244

(51) Int. Cl.
*G06C 27/00* (2006.01)
*B67D 7/22* (2010.01)
*A61J 7/04* (2006.01)

(52) U.S. Cl.
CPC ... *B67D 7/22* (2013.01); *A61J 7/04* (2013.01); *A61J 2205/30* (2013.01)
USPC ..... 235/66; 235/61 R

(58) Field of Classification Search
USPC ..... 235/61 R, 66, 67, 419
See application file for complete search history.

(56) References Cited

U.S. PATENT DOCUMENTS

| | | | | |
|---|---|---|---|---|
| 5,997,475 | A | 12/1999 | Bortz | |
| 6,068,149 | A | 5/2000 | Telega | |
| 6,152,067 | A * | 11/2000 | Mathison | 116/308 |
| 6,276,533 | B1 | 8/2001 | Kaplan | |
| 6,543,682 | B1 | 4/2003 | Glaser | |
| 6,691,043 | B2 | 2/2004 | Ribeiro, Jr. | |
| 6,779,480 | B2 | 8/2004 | Zamjahn | |
| 6,925,393 | B1 | 8/2005 | Kalatz et al. | |
| 7,137,951 | B2 | 11/2006 | Pilarski | |
| 7,147,127 | B2 * | 12/2006 | Lepke et al. | 221/4 |
| 7,179,226 | B2 | 2/2007 | Crothall et al. | |
| 7,661,384 | B2 | 2/2010 | Mataya | |
| 2008/0052057 | A1 | 2/2008 | Brown | |
| 2008/0294028 | A1 | 11/2008 | Brown | |
| 2010/0006585 | A1 | 1/2010 | Flowers et al. | |

FOREIGN PATENT DOCUMENTS

WO 0032258 6/2000

OTHER PUBLICATIONS

International Search Report PCT/NZ2011/000273 dated Mar. 13, 2012.

* cited by examiner

*Primary Examiner* — Daniel St Cyr
(74) *Attorney, Agent, or Firm* — Young & Thompson

(57) ABSTRACT

The invention provides a device for recording information relating to, and/or calculating a required medication dosage on the basis of, a plurality of variable factors influencing a medication requirement, in particular for the management of diabetes. The device comprises a substantially cylindrical body and at least one annular dial mounted to the body and selectively rotatable about the circumference thereof.

19 Claims, 6 Drawing Sheets

MEDICATION CALCULATOR AND RECORDER

FIELD

This invention relates to a device for recording information and calculating dosages relating to consumption of medication. More particularly, the device can be used to record information relating to factors which may affect the level of medication required, and/or for calculating a required dosage of medication on the basis of two or more factors.

BACKGROUND

A number of diseases or conditions require regularly self-administered medication by the patient. If treatment requires variable doses which are dependent on a number of factors, it can be difficult for the patient to correctly estimate or calculate the required dosage.

Diabetes mellitus, more commonly referred to as simply diabetes, is an example of a chronic condition which requires continual self-administered medication to manage blood sugar levels and maintain a normal concentration of glucose in the blood ("euglycemia"). Type 1 diabetes results from the body's failure to produce insulin, and is treated or controlled with regular insulin injections. Type 2 diabetes results from cells which do not respond to or properly use the insulin produced naturally, and is controlled with insulin injections, or more commonly orally-administered medication which lowers glucose levels in the blood, known as oral hypoglycemic or antihyperglycemic agents.

One of the difficulties in self-administered medication for conditions such as diabetes is calculating the correct dosage of medication which is influenced by a number of variable factors. Diabetes requires daily, or even hourly, monitoring and precisely calculated medication dosages to successfully manage the disease. Physicians and/or other healthcare professionals cannot provide this service without significant expense and inconvenience, and new patients in particular invariably lack the knowledge, expertise, and/or experience to do so themselves without assistance.

Newly diagnosed diabetics often receive verbal and written diabetes education from a health-care professional, who will create a treatment plan tailored to the patient's requirements. The treatment plan is based upon a range of factors such as the patient's age, weight, activity and diet. However, diabetes is a 24 hour-a-day, 365 day-a-year condition that requires frequent monitoring and self-administration of medication to match varying day-to-day needs.

There are many factors that a diabetic has to consider when calculating their medication requirements, which can leave patients feeling overwhelmed and often left wondering why their blood glucose levels might not be at a healthy range, potentially leading to further stress which can further adversely affect the patient's blood glucose level.

The patient has previously been required to estimate the required dosage of medication either by guesswork, paperwork, calculating numbers in their head, or using a software programme or electronic device.

U.S. Pat. No. 6,543,682 entitled "Insulin-dose calculator disk", for example, discloses a disk for determining an appropriate insulin injection dosage to be taken with a meal. The disk comprises a pair of co-axial circular members. By rotating the front member to align a window with one of a plurality of ingested carbohydrate values arranged around the outer perimeter of the rear member, an array of insulin injection dosage values printed radially on the rear member are revealed through a viewing panel or window in the front member. Printed radially on the front member adjacent the window are a range of blood glucose levels. The user thus turns the front member to align the window with the appropriate weight of carbohydrates to be consumed. After measuring blood glucose levels, the corresponding insulin injection dosage can be read from the window. The disk thus allows a patient to estimate the required dosage based upon the variable factors of food intake and present glucose levels, but is limited to those two factors alone. Furthermore, the calculator disk comprises an additional item which the patient must remember to carry with them and/or their medication, and the size and/or shape of the disk makes it inconvenient for doing so.

A number of electronic devices or calculators have also been devised to assist with estimating required medication dosages. However, these have the similar disadvantage in that they present another item which the patient must carry with them. The device may also be unnecessarily difficult to use, in particular for the elderly or very young unaccustomed to operating such devices. The devices are also dependent upon a power supply for operation.

Mobile devices, in particular mobile telephones, commonly already carried by many people now typically have the ability of executing third-party software. A calculator software programme designed to run on such a device has the further disadvantage of potentially not being able to be used in some environments, such as during a flight, for example, if the mobile telephone does not have a flight mode which can be easily enabled. Mobile telephones may also have a limited battery life of several days or less with heavy use.

U.S. Pat. No. 6,779,480 entitled "Dial indicator cap" discloses a cap for a container comprising a rotatable dial on top of the cap, with windows therein adapted to reveal information printed on the top of the cap. The device is adapted for "determining the required amount of a substance, such as a medication, as a function of a variable", such as the weight of a patient. The dial is rotated such that a first viewing window displays a paediatric patient's weight, with the corresponding dosage being revealed by the second, diametrically opposed, viewing window. A third viewing window may also be provided, to display further information dependent upon the patient's weight, such as a higher initial dose and/or lower subsequent doses. However, the disclosed device cannot easily be adapted to calculate a required dosage based upon a plurality of variable factors.

In some cases, it may also be necessary for a patient to record information relating to the plurality of factors affecting required medication levels. This information may be relevant for the determination of personalised adjustment ratios necessary for the patient to accurately calculate or estimate the correct medication dosages. The aforementioned prior art devices cannot easily be adapted by the patient to record that information.

OBJECT OF THE INVENTION

It is therefore an object of the invention to provide a device which overcomes or at least ameliorates one or more disadvantages of the prior art, or at least to provide the public with a useful choice.

Further objects of the invention will become apparent from the following description.

SUMMARY OF INVENTION

Accordingly in one aspect the invention may broadly be said to consist in a device for recording information relating to, and/or calculating a required medication dosage on the basis of, a plurality of variable factors influencing a medication requirement, the device comprising a substantially cylindrical body and at least one annular dial mounted to the body and selectively rotatable about the circumference thereof.

Preferably the body comprises a container.

In a mechanical embodiment of the invention, the invention preferably comprises a plurality of independently rotatable co-axial annular dials.

Preferably the plurality of rotatable annular dials are each provided about their circumference with indicia indicative of a plurality of measurements of at least one of said variable factors.

Preferably one or more of the plurality of rotatable annular dials are each further provided about their circumference with indicia indicative of medication adjustment modifiers corresponding with the respective variable measurements.

Preferably the plurality of rotatable annular dials are each adapted to be rotated to align appropriate variable measurements on each dial, wherein an appropriate dosage can be estimated from the plurality of aligned medication adjustment modifiers corresponding with said appropriate variables.

Preferably the appropriate dosage can be estimated by summing the plurality of aligned medication adjustment modifiers.

Preferably the plurality of dials are each indexed for incremental rotation, whereby rotation of each dial occurs in increments corresponding to the number of indicia on the dial, or convenient fractions thereof.

Preferably the container is provided with a marking with which the dials can be aligned.

In an alternative, electronic, embodiment of the invention, the invention preferably further comprises an electronic display and a processing means communicatively coupled with the or each dial and the electronic display.

Preferably the or each dial comprises a rotary encoder.

Preferably the device comprises a single dial, and further comprises an additional input means which may be used in combination with the dial to input information relating to the plurality of variable factors.

Preferably the body comprises a lid for a container.

Preferably the device further comprises a data input/output interface communicatively coupled with the computing means.

Preferably the processing means is adapted to receive from the or each dial an input relating to said plurality of variable factors, and to display said input on the electronic display.

Preferably the processing means is further adapted to calculate a required dosage on the basis of the input, and to display the required dosage on the electronic display.

Preferably the or each rotatable annular dial is mounted coaxially with the container.

Preferably the device is adapted for recording information relating to, and/or calculating a required medication dosage for, treatment of diabetes, and the variable factors comprise at least one variable factor selected from the group consisting of food intake, exercise level, blood glucose level, and prior medication.

Preferably the container may be used to house medication and/or diagnostic means.

According to a further aspect, the invention may broadly be said to consist in a method of using the device according to any one of the preceding statements to calculate a required dosage, comprising the steps of rotating the or each dial to input an indication of each of said plurality of variable factors, and reading the required dosage from the device.

Preferably the step of reading the required dosage from the device comprises summing aligned variables of a plurality of dials by rotating a required dosage dial, and reading the required dosage from the required dosage dial.

Alternatively the step of reading the required dosage from the device comprises reading a calculated dosage from an electronic display.

Further aspects of the invention, which should be considered in all its novel aspects, will become apparent from the following description.

DRAWING DESCRIPTION

A number of embodiments of the invention will now be described by way of example only with reference to the drawings in which.

DETAILED DESCRIPTION OF THE DRAWINGS

Figure 1:
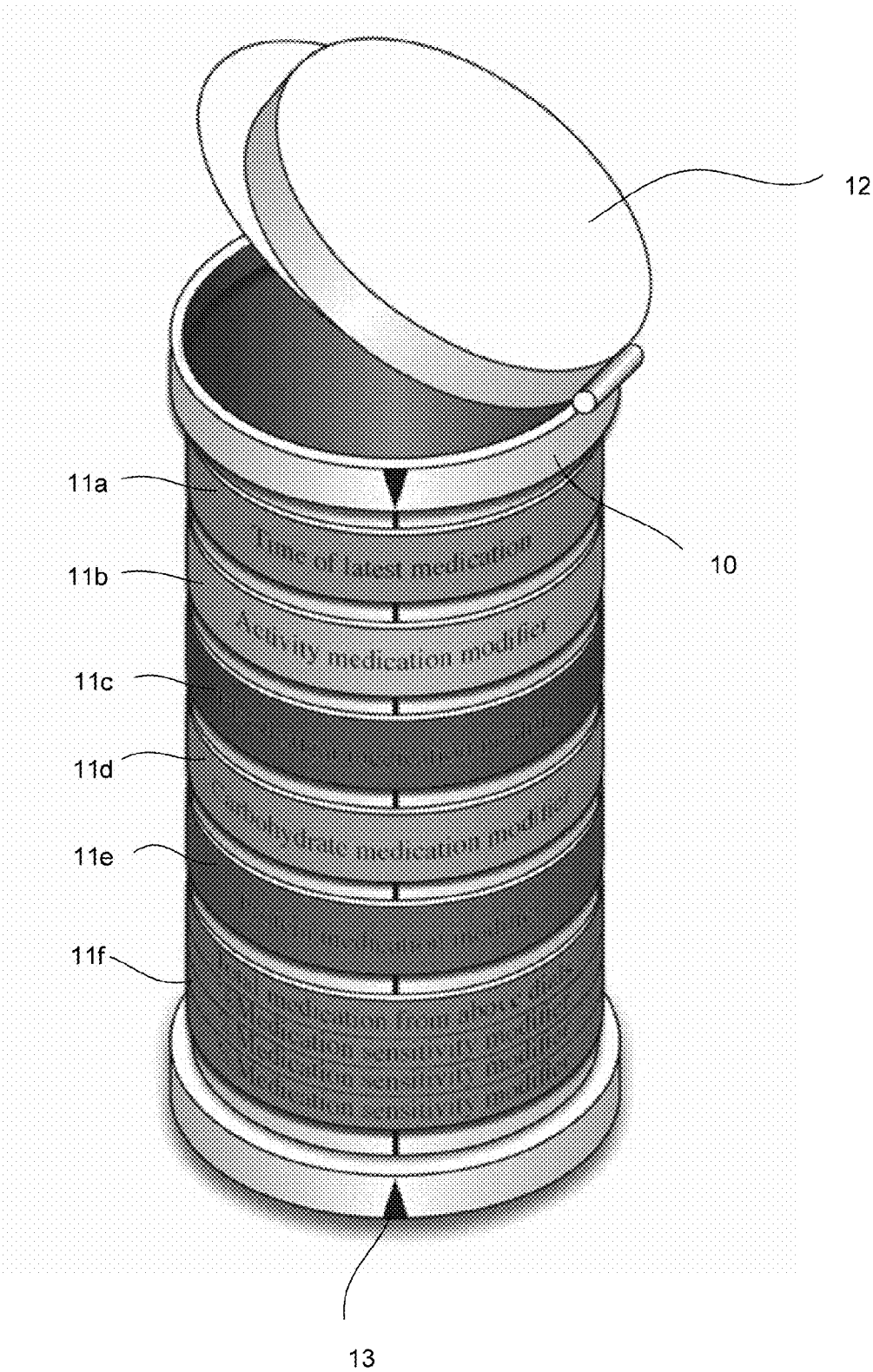
FIG. 1 is a diagram of a dosage calculator device according to a first embodiment of the present invention.

Throughout the description like reference numerals will be used to refer to like features in different embodiments.

Referring generally to FIGS. 1, 3, 5 and 6, which illustrate various embodiments of the present invention, the invention can broadly be said to consist in a substantially cylindrical body (which in most embodiments comprises a hollow container 10, but in at least one embodiment may be a lid 12 for a container) which is provided with at least one annular rotatable dial.

The dials are preferably colour-coded, so that they can easily be visually distinguished from the other dials and/or container.

The or each dial 11 preferably comprises an annular dial co-axial with, and rotatable about the circumference, of the body (container 10 or lid 12). The or each dial is preferably configured for indexed or ratcheting movement whereby the dials are set to move a predetermined distance or increment in each movement so that indicia upon the dials "click" into place in vertical/axial alignment, and remain in place while the user moves the next/previous dial. The dials should therefore be configured to move only with an appropriate amount of force so that they do not move inadvertently, without being difficult to rotate as and when required.

The or each dial is provided to calculate an appropriate dosage of medication to be consumed based upon a plurality of variable factors which influence the required dosage for effective treatment (as in the embodiments of FIGS. 1, 5, and 6), or to record information relating to the variable factors, in particular so that the calculator embodiment can be personalised for effective use by the patient as described in further detail below.

The container preferably comprises a lid 12 such that the container can be used to store medication and/or diagnostic means, such as glucose tablets and/or blood glucose testing strips. The device may thus be used in place of standard medication or diagnostic containers, such that the patient is not required to carry anything additional with them.

Preferred embodiments of the invention will be described below by way of example only, in which the devices are adapted for calculating dosages and/or recording information for a diabetic. However, it is to be appreciated that the device may have other applications and is not limited to use in the treatment of diabetes.

EXAMPLE 1

A first embodiment of the present invention is illustrated in FIG. 1, in which it can be seen that the device comprises six annular dials, 11*a*-11*f*, the general function of each of which is indicated in the drawings. That is, the respective dials 11*a*-11*e* are used to indicate the time elapsed since a previous medication, activity levels, blood sugar levels, carbohydrate intake, and protein intake. The final dial, 11*f*, is used to sum the medication requirements indicated by dials 11*a*-11*e*. The device of FIG. 1 is thus adapted to calculate an appropriate dosage of medication for the management of diabetes by taking into account the variable factors of the time of latest medication, physical activity, blood sugar levels, carbohydrate intake, protein intake, and the patient's sensitivity to the medication. In particular, the device is adapted to calculate a bolus injection of fast-acting insulin to be taken with a meal.

Figure 2:
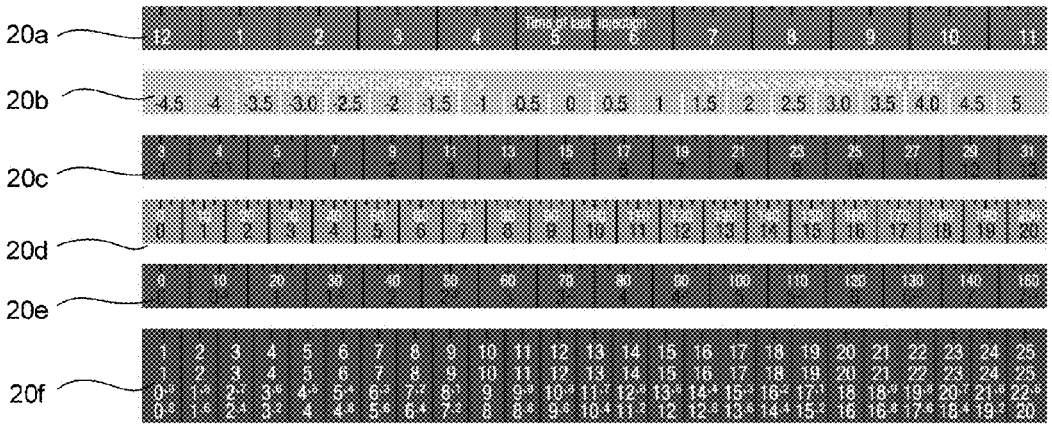
FIG. 2 is a diagram of example indicia which may be applied to the dials of the dosage calculator of FIG. 1.

The above variable factors are taken into account by providing each dial of the device with indicia such as those shown in FIG. 2, correspondingly indicated 20*a*-20*f*. The indicia are preferably provided on an adhesive label or sticker having a length corresponding with the circumference of the respective dials for attachment thereto, thereby allowing customisation or personalisation for the unique requirements of each patient, which may also vary over time. Each label thus comprises a plurality of indicia representative of at least a measure of a respective variable factor. Such labels can be easily prepared by writing on the label (preferably before it is attached to the device), or by printing indicia on a suitable adhesive label using a standard desktop computer and printer, for example.

The indicia may be in any of a number of different forms which will depend largely on the nature of the variable factor concerned (e.g. whether it is subjective or objective, for example), as shown. For example, the variable factor of the "time of last injection" of insulin 20*a* may be indicated or measured by indicia in the form of numbers 1-12, corresponding with the time (in hours) elapsed since the last injection, spread evenly about the circumference of the corresponding dial 11*a*. The variable factor of physical activity levels or stress to the body such as adrenalin, sickness, anxiousness, depression or other emotions (e.g. the "Activity medication modifier" shown on dial 11*b* of FIG. 1), which is somewhat more subjective, may be assessed by the patient on a scale of −4.5 (corresponding with intense exercise) to 5 (corresponding with sleep or rest), for example. The scale is preferably chosen to correspond with resulting modifiers to the required medication (e.g. an exercise level of −4.5 would require 4.5 fewer units of medication than if no exercise was to be undertaken).

The labels may also include additional text indicating the purpose of the dial (e.g. "Time of last injection") or the states corresponding with one or more indicia (typically at least the upper and lower limits) of a subjective scale (e.g. "<Exercise/Sports/Relaxing>-<Stress/Sickness/Dawn Rise>") as shown on labels 20*a* and 20*b*, respectively.

Other dials may be provided with two or more rows of indicia, as is the case for the labels 20*c*-20*f*. In the case of labels 20*c*-20*e*, for example the first (top) row of indicia of each label lists a plurality of possible measurements or estimates of blood sugar levels or food intake, for example, while the second (bottom) row of each label provides corresponding medication adjustment modifiers indicative of the effect which that variable will have upon the dosage of medication required. The "measurement" (or input) and "modifier" (or output) indicia are preferably visually distinguished by way of a different font colour, for example.

The final dial of this preferred embodiment, which indicates the total medication dosage required, includes three rows of indicia, with the row to be used being selected based upon the patient's sensitivity to the medication. The second and third rows are preferably predefined percentages of the dosage indicated in the first row as needed at various times of the day or with varying activity levels.

Figure 4:
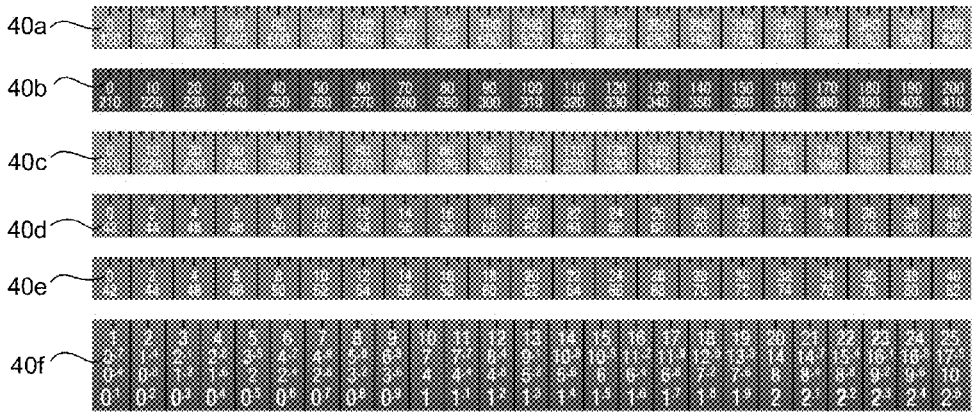
FIG. 4 is a diagram of example indicia which may be applied to the dials of the information recordal device of FIG. 3.

Movement of the dials 11*a*-11*f* is preferably indexed according to the number of indicia (or convenient increments or fractions thereof) per row on each of the labels 20*a*-20*f*, i.e. in the case of dial 11*a* having a total of 12 positions corresponding with the hour indicia of 20*a*, or more preferably a larger number of positions (e.g. 48) corresponding with quarter-hour increments, for example. The fractions of indicia corresponding with indexed or incremental movement of the dials may be indicated visually by linear-measurement markings, such as shorter transverse lines for minor increments (e.g. 0.25 units or 15 minutes) between longer transverse lines for major increments (e.g. 1 unit or 1 hour), as shown in FIGS. 2 and 4 and commonly used in tape measures and the like. The selection of appropriate major and minor increments will depend upon the nature of the variable factor and measurements thereof.

To use the device, the user rotates each of dials 11*a* to 11*f* to align the appropriate indicia corresponding with the variable factors with the marking 13 provided on the container. By rotating dial 11*f* to arrive at the sum of the aligned numerical indicia of the dials 11*a*-11*e* and selecting the appropriate medication sensitivity row, the user obtains an indication or estimate of the required dosage which takes into account all of the medication adjustment factors of the dials. According to this preferred embodiment, the required dosage is indicated in terms of the number of "units of insulin" the patient should inject using an insulin pen or pump (100 units being equivalent to 1 mL of insulin).

The user can thus easily and intuitively calculate how much medication is needed for their current activity, meal or blood glucose correction.

For example, a patient having the device set up with medication/insulin matched to the variables as in the example illustration of FIG. 4 who last took medication three hours beforehand, has had or expects to have moderate exercise corresponding to requiring 2.0 fewer units of insulin (i.e. −2.0 on the activity scale of −4.5-5.0), has a blood sugar/glucose level of 9 (i.e. 9.0 mmol/L), protein intake of 120 g and carbohydrate intake of 80 g would rotate the respective dials 11*a*-11*e* to the appropriate positions.

If three hours have elapsed since the previous medication, as in this example, that insulin would typically have finished actively lowering the patient's glucose levels. This is referred to as having zero 'insulin' on board. The medication manufacturer usually states the length of time the medication will remain active, however the exact length of time varies for each patient. A medical professional would typically advise the patient of this length of time. The medical professional may therefore set up the device with a further row of indicia (not shown in FIG. 4) indicative of medication adjustment modifiers corresponding with the respective elapsed time measurements, as with blood sugar/glucose dial 20*c* for example, or the patient may be left to determine for themselves whether there is likely to be any active medication remaining in their body, as in the illustrated example. In this case, the medication adjustment modifier corresponding to the three hours elapsed since the previous medication would be 0 units if the medication is no longer active. If any medication remains active, the medication adjustment factor would be negative (i.e. reducing the required dose).

The protein and carbohydrate intake would typically relate to the intake from the meal with which the medication is to be taken, but in other applications may be used to record the total intake since a previous medication.

Using the final dial 11*f*, the patient can then sum the medication adjustment modifiers of the dials 11*a*-11*e* (0, −2.0, 2, 12 and 4, respectively) to arrive at a total medication of 16 units (0.16 mL) of insulin. If the patient is instructed to use a medication sensitivity modifier, the dosage would be read instead from one of the second or subsequent rows of the final dial 11*f* (e.g. 14.4 or 12.8 units of insulin, respectively).

Alternatively, or additionally, following calculation the "time of latest medication dial" 11*a* can be used to record when the current dosage is taken so that when the patient next tests their blood etc., they can see they last had medication at 12:30, for example, rather than having to remember off the top of their head the time of the last injection to determine insulin on board. The patient would typically not have any difficulty remembering if the last medication was in the morning or afternoon/evening, but it will be appreciated that the indicia of this label could be easily adapted to accommodate a 24-hour scale, for example.

EXAMPLE 2

Figure 3:
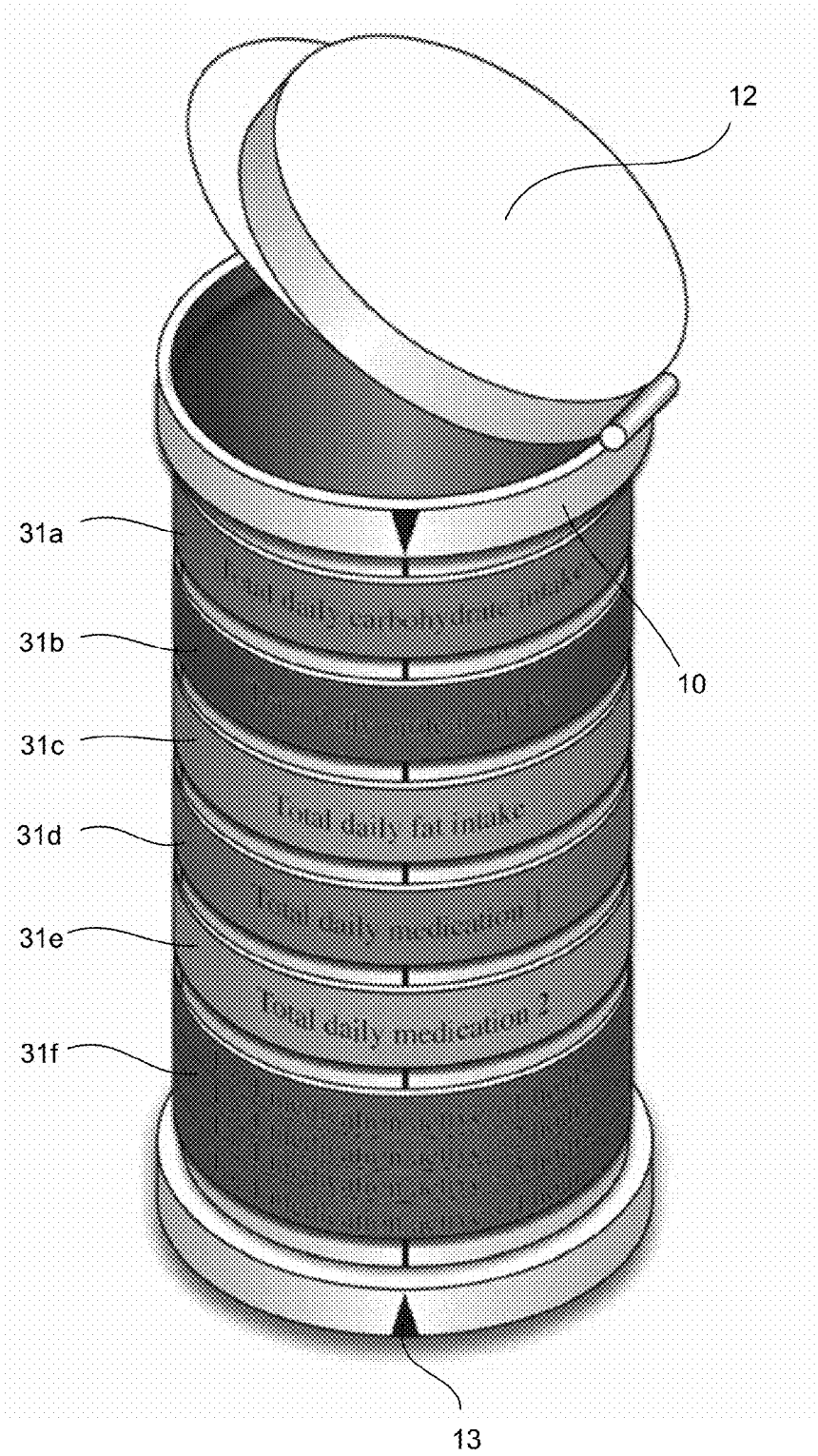
FIG. 3 is a diagram of an information recordal device according to a second embodiment of the present invention.

A second embodiment of the invention is illustrated in FIG. 3, in which the device is configured as an information recordal device. As can be seen from the drawing, the recordal device is preferably identical in terms of shape to the calculator of Example 1, but the dials 31*a*-31*e* are instead each configured to record variable factors, in particular daily food and medication intake for a diabetic, which are important for treatment of the condition.

An example of appropriate indicia 40*a*-40*f* suitable for use with this embodiment of the invention are shown in FIG. 4.

The information recorded by this embodiment of the invention can be used to track trends with software by entering the daily data in a computer, or to alter medication ratios of the dials of a calculator such as that described above as Example 1 and with reference to FIGS. 1 and 2, or to give clues to why the patient's blood glucose is not at a level it should be.

The final dial 31*f* in this embodiment can be used for a quick reference at a later time i.e. two hours after medication was taken, for the patient to quickly see how much medication is still active in the body two hours since first taking the medication. That is, by rotating the dial 31*f* to align indicia in the first row corresponding with the dosage of medication previously consumed, the corresponding indicia in the second-fourth rows of the dial provide an indication of the medicine still active after 1, 2, or 3 hours.

During the day, the user can manipulate the dials to record a rolling tally of food and medicine intake. Diligently recording this information at the end of each day results in a useful day-by-day intake history which can be used to configure the calculator embodiment or generally track trends.

EXAMPLE 3

Figure 5:
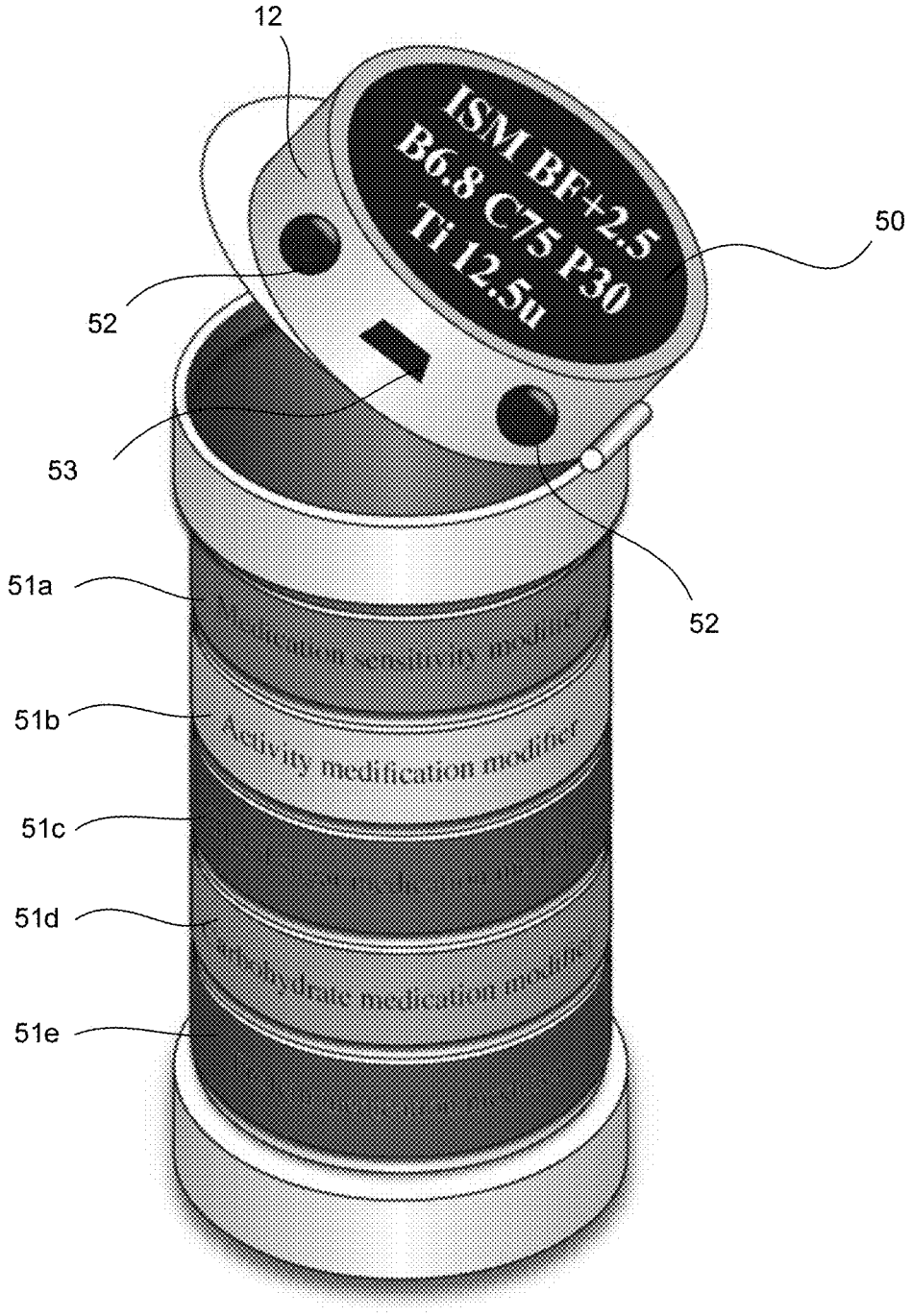
FIG. 5 is a diagram of an electronic dosage calculator device according to a third embodiment of the present invention.
Figure 6:
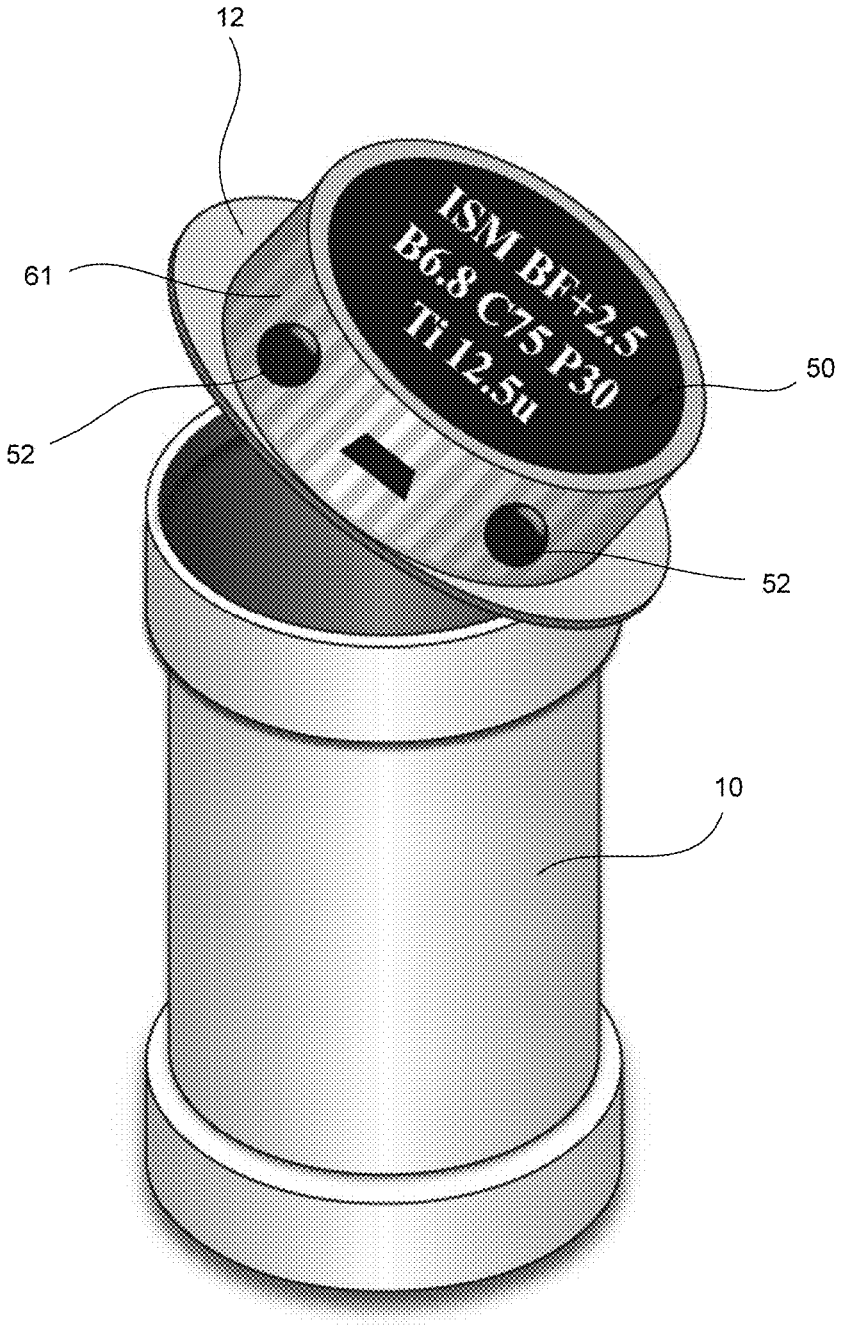
FIG. 6 is a diagram of an electronic dosage calculator device according to a fourth embodiment of the present invention.

According to a third preferred embodiment of the invention, the device comprises an electronic calculator for estimating the required dosage of medication for a diabetic, as shown by way of example in FIG. 5. The device, like the first embodiment of Example 1, comprises a substantially cylindrical container 10 with a plurality of annular dials 51*a*-51*e*. However, this embodiment further comprises an integrated computing means or computing device such as a microcontroller (not shown) communicatively coupled with the dials 51*a*-51*e* and an electronic display 50.

The electronic display 50 is preferably a small liquid crystal (LCD) display integrated in the top of the lid 12 hingedly attached to the container 10. Other electronic components, excluding the dials 51*a*-51*e*, are preferably also integrated within the lid 12.

The dials 51*a*-51*e* are preferably digital dials commonly known as rotary encoders, capable of sensing rotation of each of the dials and communicating data regarding rotation of the dials to the microcontroller, via wires or ribbon cable in or adjacent the hinge of the lid 12. The microcontroller preferably includes, or is communicatively coupled with, non-volatile memory to store data input by the user. All electronic components of the device are preferably powered by battery, which may be either disposable or rechargeable (preferably via the data input/output interface 53).

The digital dials allow the user to input to the microcontroller details relating to the variable factors of medication sensitivity 51*a*, activity levels 51*b*, blood sugar levels 51*c*, carbohydrate intake 51*d*, and protein intake 51*e*. Using these inputs, the microcontroller calculates a required dosage, which it displays to the user via the electronic display 50.

The device preferably further comprises additional input means 52 and a data input/output interface 53 enabling data communication between the computing means and an external device, such as a personal computer. The data input/output interface 53 may be used to set up the patient's unique medication modifier requirements and/or to download stored levels held in the memory for analysis by a medical professional and/or personal computer software. The additional input means 52 may be used to manipulate the display and/or switch the device on and off, for example, and preferably comprises at least one push-button.

In the illustrated example, it can be seen that the electronic display 50 simultaneously displays each of the variable factors and associated medication modifiers, where "ISM" represents the insulin sensitivity modifier, "BF" represents the activity level or "breakfast" (when recent activity levels are typically lowest due to sleep/rest), "B" represents the blood sugar/glucose level, "C" represents carbohydrate intake, "P" represents protein intake, and "Ti" represents the required total insulin injection.

EXAMPLE 4

A fourth embodiment of the invention is similar to the third example/embodiment described above, except that it comprises only a single dial 61, in this case rotatable about the circumference of the lid 12. This may be preferred to minimise manufacturing costs, for example. Integration of the dial 61 in the lid 12 obviates the need for wires between the container and the lid and reduces the complexity and cost of the device. The device may therefore be supplied as a lid only, adapted to be engaged with a standard container typically used by a diabetic to house blood glucose testing strips, for example. In that case, the lid 12 need not be hingedly engaged with the container 10, but may have a threaded engagement or merely a friction fit, for example.

Since only a single dial is provided, the additional input means 52 is required to select which of the plurality of variable factors the user wishes to input using the dial. The device may thus easily be adapted to perform either or both of the dosage calculator and food/medicine intake recorder, since only a software modification to the computing means is required to do so.

The dial is preferred for inputting measurements of the variable factors, since it is quicker and more intuitive than repeatedly pressing push-buttons of the additional input means 52, for example.

Other Variations

It is to be appreciated that many modifications or variations may be made to the preferred embodiments of the invention described by way of example above, without departing from the scope of the invention. Several such modifications are described by way of non-exhaustive example below.

In particular, it is to be appreciated that the device may be manufactured and/or sold without any labels or with labels lacking at least some indicia normally required for use, since a medical professional may be required to customise the device by preparing and/or attaching the labels themselves. A range of labels suitable for use with the device may alternatively be included with the device for selection by the medical professional or patient, or the labels may be sold separately.

According to the preferred embodiments of Examples 1-4, the required/active medicine is indicated in terms of "units of insulin". This can be easily modified, however, to indicate a required dosage in any appropriate measurement. This might include a measurement of volume, such as milliliters or micro-liters as might be the case for a diabetic injecting insulin using a syringe or any other illness requiring variable volumes of an orally-administered liquid medicine, for example, or may alternatively be a number of pills to be consumed, or an "international unit" or "IU" (which measures the effect of a substance) which will dictate the appropriate volume or mass of medication required depending on the medication available.

The example embodiments of the invention described above refer to summing the various medication adjustment modifiers. However, it is to be appreciated that in other applications the modifiers may be multipliers, dividers, or the like, without necessarily departing from the scope of the invention.

Embodiments of the invention incorporating the recording function as described above with respect to Example 2 may further include a dial for a diabetic to record the total of a long-lasting basal insulin consumed, which is commonly taken once or twice per day (this is separate of meals which may require fast-acting bolus insulin). This dial is useful as it can often be difficult for the patient to remember if they have actually taken this long lasting insulin, and if so, how much. The total amount recorded gives an indication if the patient has had, for example, one dose in the morning if on a twice-daily dosing regime, or both injections. Commonly a second injection will be 12 hours after the first injection, or in the evening.

The device may be provided to a user or distributor with a number of dials corresponding with the number of variable factors which are to be taken into account in any particular application or use of the device. However, a particular user need not necessarily use all of the dials, and one of the dials may therefore be left blank without any indicia, or otherwise simply ignored by the user if it is not necessary to make full use of all of the provided dials.

The indicia are not necessarily provided as stickers or labels, but may alternatively be engraved, embossed, or printed directly on the outer plastic or rubber surface of the dial, for example, or in the electronic embodiments of the invention may not be required at all.

While it is preferred that each dial be indexed according to the number of indicia per row on the dial, this is not necessarily a requirement of the invention. It may be preferred, for manufacturability reasons for example, that each dial be indexed identically, in which case it may not be possible for one or more dials to have a different number of potential positions.

While the electronic embodiments of the invention describe the use of digital dials, analog dials (including potentiometers, for example) may alternatively be used with an analog to digital converter for communication with the computing means (such converters typically being included in a number of microcontrollers), without necessarily departing from the scope of the invention.

The electronic display may be an LCD as described with respect to the preferred electronic embodiments, but may alternatively be any suitable display capable of displaying the required information to the user, including but not limited to an organic light emitting diode (OLED) display, or an E-Ink display.

Electronic embodiments of the invention having a plurality of dials, such as that described above as Example 3, may have dials provided with indicia such as those shown in FIG. 2 to allow use without checking the display, but may alternatively have dials marked merely with the function of the dial (i.e. the name or a description of the variable factor associated with the dial, without any measurements thereof), as shown in FIG. 5. In the former case, the dial should comprise an absolute rotary encoder so that the data communicated to the microprocessor corresponds with the visual information seen by the user. In the latter case, however, the microcontroller may simply display the input on the electronic display in real time for the user to view and adjust accordingly, in which case a relative or incremental rotary encoder will suffice so that the user can simply rotate the dial one way or the other as required to reach the necessary variable value (measurement) shown on the electronic display.

From the above description, it will also be apparent to a skilled person how the electronic embodiments of the invention may additionally or alternatively be adapted to perform the function of a recorder. In fact, the memory of the computing means and the input-output interface 53 make the electronic embodiments particularly suited to this application, since the user will no longer be required to make a daily note of the totals recorded using the device before it is "reset" for use the following day.

In a further development of various embodiments of the invention, one or more dials of the device may be geared and/or motorised such that a required dosage dial is automatically rotated to indicate a required dosage upon turning the or each dial associated with the variable factors.

The invention has been described above with respect to the monitoring and treatment of diabetes, but may also be used for any other application in which a plurality of variable factors should be taken into consideration in calculating or estimating the correct or best course of action, and in particular those which benefit from the storage provided by the container of the invention.

Although this invention has been described by way of example and with reference to possible embodiments and variations thereof, it is to be understood that further modifications or improvements may be made thereto without departing from the scope of the invention. The invention may also be said broadly to consist in the parts, elements and features referred to or indicated in the specification of the application, individually or collectively, in any or all combinations of two or more of said parts, elements or features. Furthermore, where reference has been made to specific components or integers of the invention having known equivalents, then such equivalents are herein incorporated as if individually set forth.

From the foregoing it will be seen that the invention provides a convenient and intuitive device for recording information and/or calculating or estimating a required medication dosage. In particular, the device is simple to use, and doubles as a container to replace an existing container and avoid burdening the user with an additional item to carry or remember. The mechanical embodiments of the invention are also reliable, inexpensive, and not dependent on batteries, while the electronic embodiments can be easily interfaced with external computers for data exchange and configuration, and are susceptible to having a very long battery life.

Unless the context clearly requires otherwise, throughout the description, the words "comprise", "comprising", "include", "including", and the like, are to be construed in an inclusive sense as opposed to an exclusive or exhaustive sense, that is to say, in the sense of "including, but not limited to".

Any discussion of the prior art throughout the specification should in no way be considered as an admission that such prior art is widely known or forms part of common general knowledge in the field.

The invention claimed is:

1. A device for calculating a required medication dosage on the basis of a plurality of variable factors influencing a medication requirement, the device comprising a substantially cylindrical container and a plurality of independently rotatable co-axial annular dials mounted to the container and selectively rotatable about the circumference thereof, each of the plurality of rotatable annular dials being provided about their circumference with indicia indicative of a plurality of measurements of at least one of said variable factors, and one or more of the plurality of rotatable annular dials are further provided about their circumference with indicia indicative of medication adjustment modifiers corresponding with the respective variable measurements.

2. The device of claim 1, wherein the plurality of rotatable annular dials are each adapted to be rotated to align appropriate variable measurements on each dial, wherein an appropriate dosage can be calculated at least in part from the plurality of aligned medication adjustment modifiers corresponding with said appropriate variables.

3. The device of claim 2, wherein the appropriate dosage can be calculated by summing the plurality of aligned medication adjustment modifiers.

4. The device of claim 1, wherein each of the plurality of dials are indexed for incremental rotation, whereby rotation of each dial occurs in increments corresponding to the number of indicia on the dial, or convenient fractions thereof.

5. The device of claim 1, wherein the container is provided with a marking with which the dials can be aligned.

6. The device of claim 1 further comprising an electronic display and a processing means communicatively coupled with at least one dial and the electronic display.

7. The device of claim 6 wherein at least one of the dials communicatively coupled with the processing means comprises a rotary encoder.

8. The device of claim 6 further comprising an additional input means which may be used in combination with the at least one dial communicatively coupled with the processing means to input information relating to the plurality of variable factors.

9. The device of claim 6, further comprising a data input/output interface communicatively coupled with the processing means.

10. The device of claim 6, wherein the processing means is adapted to receive from the or each dial communicatively coupled therewith an input relating to at least one of said plurality of variable factors, and to display said input on the electronic display.

11. The device of claim 10 wherein the processing means is adapted to calculate a required dosage on the basis of the input, and to display the required dosage on the electronic display.

12. The device of claim 1, wherein at least one of the plurality of dials is provided on a lid of the container.

13. The device of claim 1, wherein the device is adapted calculating a required medication dosage for, treatment of diabetes, and the variable factors comprise at least one variable factor selected from the group consisting of food intake, exercise level, blood glucose level, and prior medication.

14. The device of claim 1, wherein the container may be used to house medication and/or diagnostic means.

15. The device of claim 1 adapted for calculating a required insulin dosage for treatment of diabetes, wherein the medication adjustment modifiers represent a quantity of insulin corresponding with the respective variable measurements.

16. The device of claim 15, wherein the medication adjustment modifiers represent a quantity of insulin corresponding with the respective variable measurements of at least one of the variable factors of blood glucose level and food intake.

17. A method for calculating a required dosage, comprising:

providing a device comprising a substantially cylindrical container and a plurality of independently rotatable co-axial annular dials mounted to the container and selectively rotatable about the circumference thereof, each of the plurality of rotatable annular dials being provided about their circumference with indicia indicative of a plurality of measurements of at least one of said variable factors, and one or more of the plurality of rotatable annular dials being further provided about their circumference with indicia indicative of medication adjustment modifiers corresponding with the respective variable measurements;

rotating the plurality of co-axial annular dials to input an indication of each of said plurality of variable factors; and reading the required dosage from the device.

18. The method of claim 17, wherein the step of reading the required dosage from the device comprises summing aligned medication adjustment factors of the plurality of dials by rotating a required dosage dial, and reading the required dosage from the required dosage dial.

19. The method of claim 17, wherein the step of reading the required dosage from the device comprises reading a calculated dosage from an electronic display of the device.

* * * * *